US010058218B2

(12) United States Patent
Purvis

(10) Patent No.: US 10,058,218 B2
(45) Date of Patent: Aug. 28, 2018

(54) DISPOSABLE FACIAL HAIR GROOMING SINK LINER AND WIPE SYSTEMS

(71) Applicant: Jason Purvis, North Vancouver (CA)

(72) Inventor: Jason Purvis, North Vancouver (CA)

( * ) Notice: Subject to any disclaimer, the term of this patent is extended or adjusted under 35 U.S.C. 154(b) by 0 days.

(21) Appl. No.: 15/226,474

(22) Filed: Aug. 2, 2016

(65) Prior Publication Data

US 2018/0035847 A1 Feb. 8, 2018

(51) Int. Cl.
*A47K 1/06* (2006.01)
*A45D 27/00* (2006.01)

(52) U.S. Cl.
CPC ..... *A47K 1/06* (2013.01); *A45D 27/00* (2013.01)

(58) Field of Classification Search
CPC ..... A47K 1/06
USPC ..... 4/619–660, 665
See application file for complete search history.

(56) References Cited

U.S. PATENT DOCUMENTS 1,703,053 A * 2/1929 Belles ..... A47K 1/06 4/655
1,987,020 A * 1/1935 Looft ..... A47K 1/06 4/655
2,147,805 A * 2/1939 Windsor ..... A47K 1/06 4/655
2,634,229 A * 4/1953 Roux De Wet ..... A61F 13/8405 424/431
2,817,851 A * 12/1957 Barnwell ..... A47K 1/06 4/655
4,106,133 A * 8/1978 Roberts ..... A47K 3/001 4/621
4,870,924 A * 10/1989 Wolfe ..... A01K 1/0107 119/167
5,040,252 A * 8/1991 Taggart ..... A47K 3/008 4/580
5,067,185 A * 11/1991 Kohler ..... A47K 13/16 4/245.1
5,135,518 A * 8/1992 Vera ..... A61F 7/02 602/41
5,153,950 A * 10/1992 Sowers ..... A47K 3/001 4/580
5,815,855 A * 10/1998 McKeehan ..... E03C 1/186 165/185
5,991,942 A * 11/1999 Neal ..... A47K 1/06 4/654
6,609,258 B1 * 8/2003 Clements ..... B08B 3/006 206/576
6,959,461 B1 * 11/2005 Sanchez ..... A47J 47/20 4/654

(Continued)

*Primary Examiner* — Lori Baker
(74) *Attorney, Agent, or Firm* — Integrity Patent Group, PLC; Edwin Wold

(57) ABSTRACT

A disposable facial hair grooming sink liner and wipe for collecting shaved hairs over a sink when a person is shaving or cutting facial, head, or other bodily hair over the sink. The disposable facial hair grooming sink liner and wipe includes an absorbent biodegradable liner having a liquid composition saturating a body of the absorbent biodegradable liner. Also included is a liner package useful for retaining the absorbent biodegradable liner when in a folded-condition. The liner package may be ripped open by a user and the absorbent biodegradable liner may be unfolded and deployed about and around the sink and is useful for collecting shaved hairs for easy and environmentally friendly disposal.

17 Claims, 5 Drawing Sheets

(56) References Cited

U.S. PATENT DOCUMENTS

| | | | | |
|---|---|---|---|---|
| 7,325,694 | B2 * | 2/2008 | Bushey | A47J 47/20 210/464 |
| 7,661,149 | B2 * | 2/2010 | Ottah | A45D 44/08 2/50 |
| 7,685,654 | B1 * | 3/2010 | Jones | A47K 1/06 4/245.6 |
| 7,951,292 | B1 * | 5/2011 | De La Torre | E03C 1/264 210/164 |
| 9,032,567 | B1 * | 5/2015 | Galgano | E03C 1/186 4/657 |
| 9,080,322 | B1 * | 7/2015 | Rodrigues | E03C 1/186 |
| 9,364,123 | B1 * | 6/2016 | Mirzoev | A47K 11/02 |
| 9,493,934 | B2 * | 11/2016 | Clayton | E03C 1/186 |
| 2004/0126585 | A1 * | 7/2004 | Kerins | A61L 15/62 428/411.1 |
| 2004/0134923 | A1 * | 7/2004 | Aquino | B65F 1/0006 383/121 |
| 2007/0107116 | A1 * | 5/2007 | Zamberlan | A47K 11/06 4/484 |
| 2007/0180610 | A1 * | 8/2007 | Mohr | E03C 1/186 4/655 |
| 2008/0201840 | A1 * | 8/2008 | Hill | A47K 1/06 4/655 |
| 2010/0325791 | A1 * | 12/2010 | Davidowitz | A47K 1/06 4/655 |
| 2015/0101244 | A1 * | 4/2015 | Versteylen | A01N 3/02 47/41.01 |
| 2016/0032573 | A1 * | 2/2016 | Gavin | E03C 1/186 4/654 |

* cited by examiner

DISPOSABLE FACIAL HAIR GROOMING SINK LINER AND WIPE SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of liners and more specifically relates to a sink liner.

2. Description of Related Art

Shaving with an electric razor, beard trimmer or clippers has always leaves fine pieces of hair that is messy and hard to clean up. Right now you only have one of two options and that is to rinse the hair down the drain, or wipe the hair up with a towel. The down side to rinsing hair down the drain is that hair is number one cause in clogged drains, which can amount to expensive repairs. The down side to wiping up is that it is too time consuming and frustrating to locate and wipe up every single piece of hair.

Public health concerns have resulted in many public toilet facilities in restaurants, airports, aircraft, and similar places providing toilet seat covers. These toilet seat covers generally consist of a sheet of paper with a partially cut-out center section. When placed in use, the center section must be torn away or partially separated from the rest of the cover and the cover is then placed on the toilet seat. No such covers are contemplated or provided by airlines on extended flights, such as international travel, where sinks are likely to be used for shaving with either conventional or electric razors.

When public used as such, often times the user fails to adequately clean the sink afterwards. Conventional paper towels, while available and could be used by a conscientious person to cover a sink, they would generally be inadequate as the paper would fall into the basin and/or become wetted if it touches the drain area where water often is present. Further, even if paper towels were to be used to line a sink, paper towels are flimsy, with no means for attachment to the sink, as that is not their intended use. Also, since existing bathroom materials, at most could simply be placed over the sink, they would easily displaced when rubbish is dropped onto them or simply slip from the rim of the sink during use. There is a need for an inexpensive biodegradable sink cape for easy clean up.

Several attempts have been made to solve the above-mentioned problems such as those found in U.S. Pub. No. 2016/0032573 to Gavin, U.S. Pub. No. 2007/0180610 to Mohr, U.S. Pub No. 2008/0201840 to Hill, U.S. Pat. No. 7,685,654 to Jones, U.S. Pat. No. 5,991,942 to Neal, and U.S. Pub. No. 2010/0325791 to Davidowitz. This art is representative of sink liners. However, none of the above inventions and patents, taken either singly or in combination, is seen to describe the invention as claimed.

BRIEF SUMMARY OF THE INVENTION

Preferably, a disposable facial hair grooming sink liner and wipe should provide a biodegradable sink liner useful for collecting shaved and clipped hairs about and around a sink, and, yet would operate reliably, and be manufactured at a modest expense. Thus, a need exists for a reliable disposable facial hair grooming sink liner and wipe to avoid the above-mentioned problems.

In view of the foregoing disadvantages inherent in the known liner art, the present disclosure provides a novel disposable facial hair grooming sink liner and wipe. The general purpose of the present invention, which will be described subsequently in greater detail is to provide a disposable liner which is deployable about and around a bathroom sink or faucet and which may be useful for collecting clipped/shaved hairs when a user is shaving or cutting his or her hair over the sink.

A disposable facial hair grooming sink liner and wipe is disclosed in a preferred embodiment comprising: an absorbent biodegradable liner having a body, a first surface, and a second surface; a liquid composition saturating the body; and a liner package. The absorbent biodegradable liner, the liquid composition, and the liner package are in functional combination.

The absorbent biodegradable liner is structurally defined by the first surface and the second surface of the body, and forms a dimensional shape. Further, the liner package is structured and arranged to sanitarily retain the absorbent biodegradable liner when in a folded-condition. In use, the absorbent biodegradable liner is deployable about and around a sink when in an unfolded-condition. It should be appreciated that the disposable facial hair grooming sink liner and wipe is configured to collect shaved hairs during shaving and hair cutting over the sink.

The body of the absorbent biodegradable liner may comprise a through-hole and a narrow slit. The through-hole is structured and arranged such that the absorbent biodegradable liner may fit around a faucet neck of a sink. The narrow slit may permit a user to position the through-hole around the faucet neck.

The present invention holds significant improvements and serves as a disposable facial hair grooming sink liner and wipe. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, disposable facial hair grooming sink liner and wipe, constructed and operative according to the teachings of the present invention.

The various embodiments of the present disclosure will hereinafter be described in conjunction with the appended drawings, wherein like designations denote like elements.

DETAILED DESCRIPTION

Figure 1:
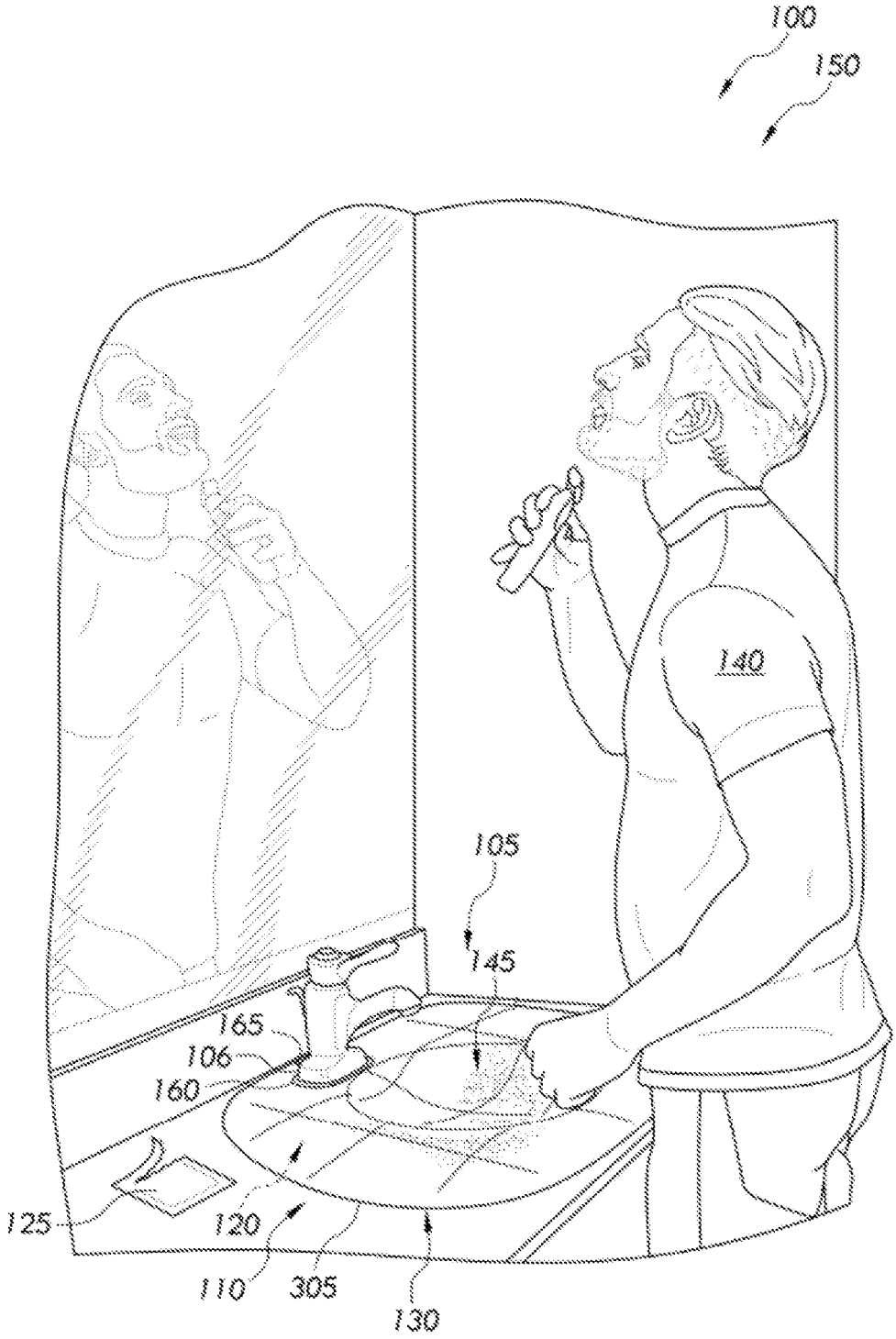
FIG. 1 shows a perspective view illustrating a disposable facial hair grooming sink liner and wipe during an 'in-use' condition, showing an absorbent biodegradable liner deployed about and around a bathroom sink and collecting shaved hairs as a user shaves over the bathroom sink, according to an embodiment of the present disclosure.
Figure 2:
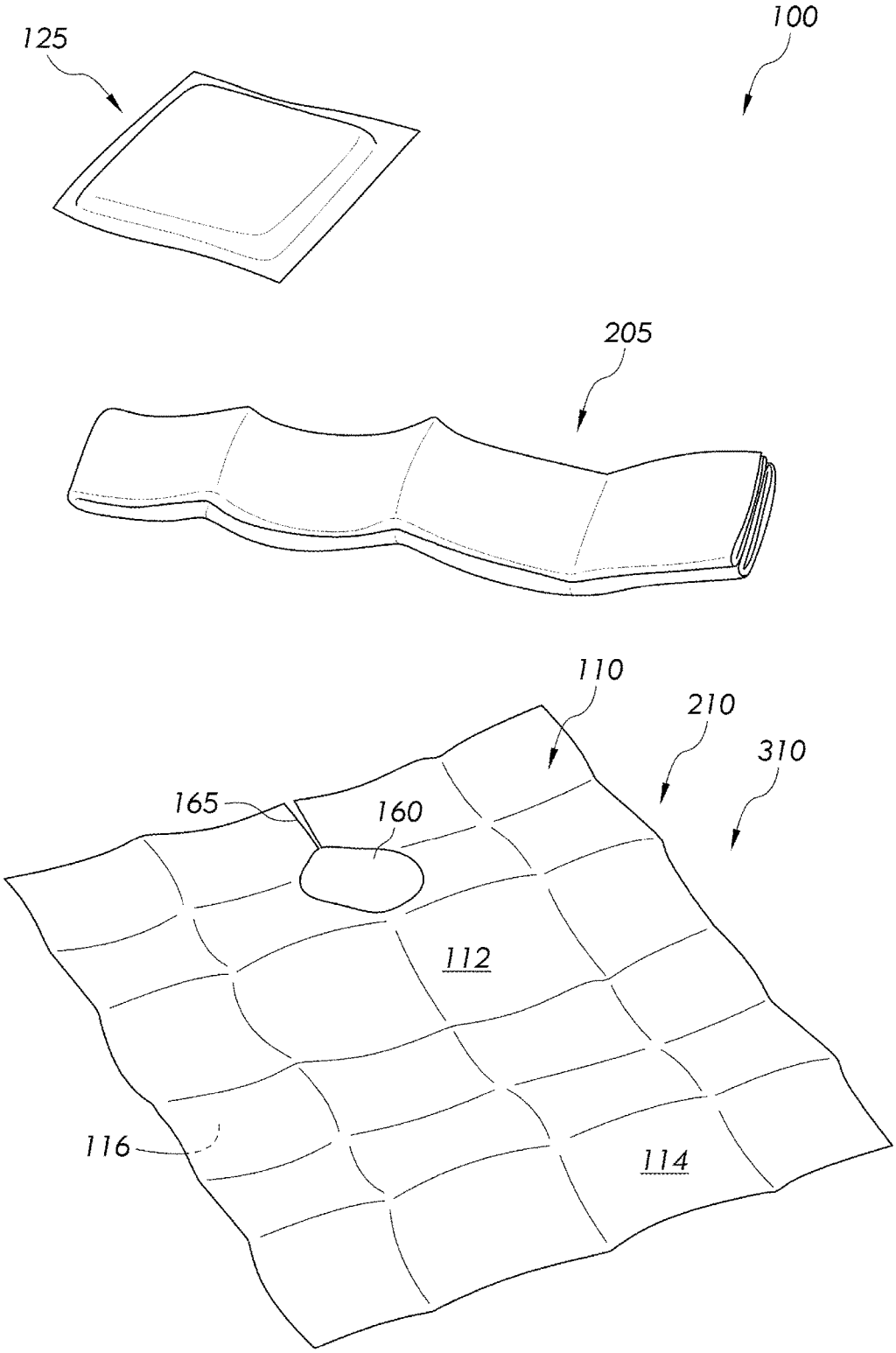
FIG. 2 is a perspective view illustrating the disposable facial hair grooming sink liner and wipe of FIG. 1 in various states or conditions, including a folded and an unfolded condition, according to an embodiment of the present disclosure.

As discussed above, embodiments of the present disclosure relate to a sink liner, and more particularly to a disposable facial hair grooming sink liner and wipe as used to improve hygienic and sanitary conditions of a bathroom sink.

Generally speaking, the disposable facial hair grooming sink liner and wipe may comprise a disposable liner which is deployable about and around a bathroom sink or faucet and which may be useful for collecting clipped/shaved hairs when a user is shaving or cutting his or her hair over the sink.

Referring to the drawings by numerals of reference there is shown in FIGS. 1-5, disposable facial hair grooming sink liner and wipe 100 comprising: absorbent biodegradable liner 110 having body 112, first surface 114, and second surface 116; liquid composition 120 saturating body 112; and liner package 125. Absorbent biodegradable liner 110, liquid composition 120, and liner package 125 are in functional combination disposable facial hair grooming sink liner and wipe 100.

As shown in FIG. 1, an example of disposable facial hair grooming sink liner and wipe 100 may be seen during 'in-use' condition 150 showing absorbent biodegradable liner 110 deployed about and around sink 105 of a bathroom and collecting shaved hairs 145 of user 140, while user 140 shaves over sink 105, thereby minimizing a mess and promoting hygienic and sanitary conditions of sink 105.

Referring now to FIGS. 1-4, absorbent biodegradable liner 110 is shown as being structurally defined by first surface 114 and second surface 116 of body 112, and forming dimensional shape 130. Liner package 125 is structured and arranged to sanitarily retain absorbent biodegradable liner 110 when in folded-condition (see ref., partially folded condition 205) and/or to retain moisture. Further, absorbent biodegradable liner 110 may be deployable by user 140 about and around sink 105 when in unfolded-condition 210. It should be appreciated that disposable facial hair grooming sink liner and wipe 100 is designed and configured to collect shaved hairs 145 of user 140 during shaving. It should further be noted that disposable facial hair grooming sink liner and wipe 100 is also designed and configured to collect and/or retain cut or clipped hair of user 140 when user 140 is cutting hair over sink 105.

Figure 3:
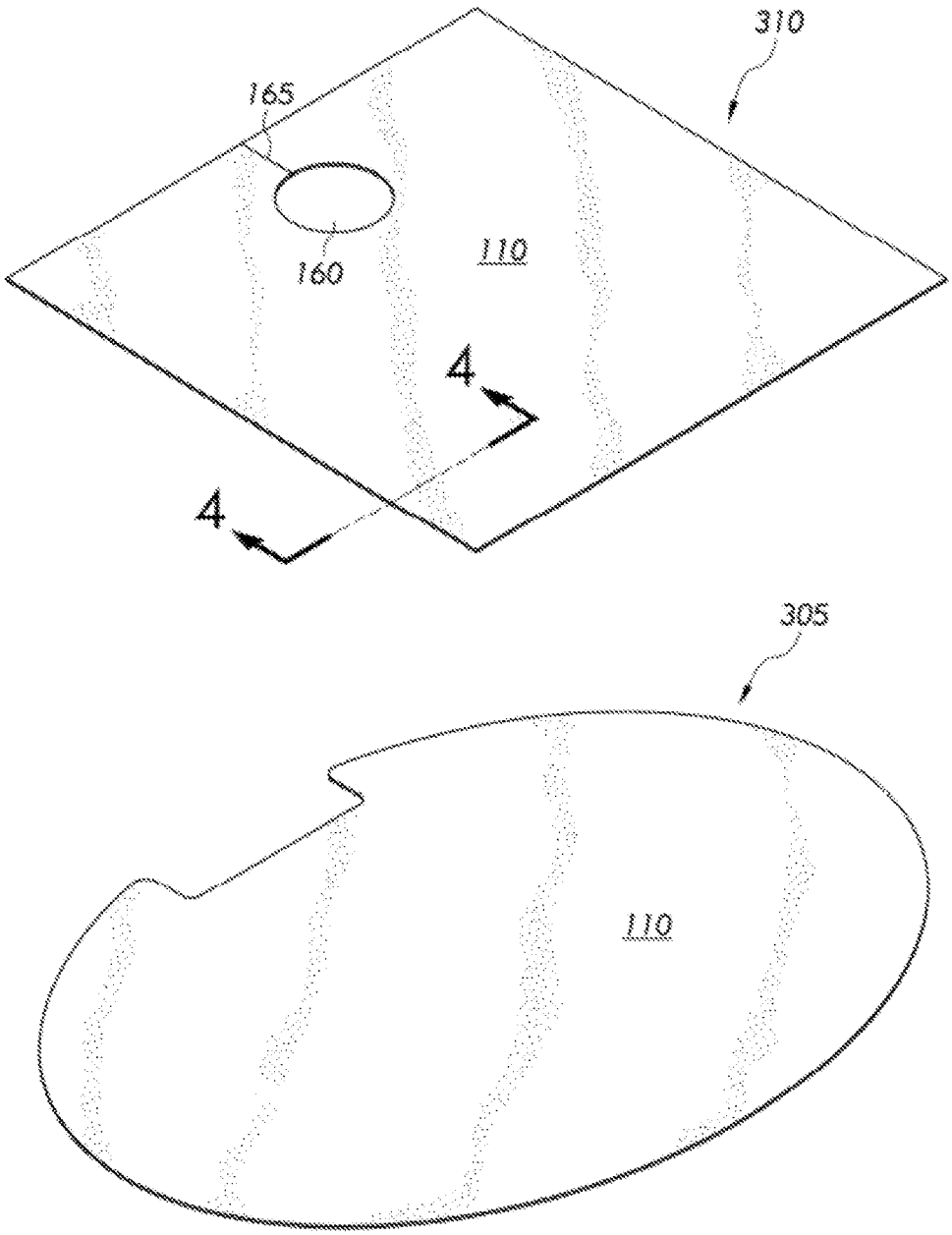
FIG. 3 is a perspective view illustrating two embodiments of the present disclosure, including a liner having an oval shape and having a through-hole and a narrow slit structured and arranged to accommodate a faucet neck of a sink and a rectangular shape having a notch structured and arranged to accommodate a faucet neck of a sink.

Referring now to FIG. 3, body of absorbent biodegradable liner advantageously includes through-hole 160. As shown best in FIG. 1, through-hole 160 is structured to accommodate faucet neck 106 of sink 105. Through-hole 160 is preferably located at an upper middle region of body 112, near an edge, and/or away from its center.

Furthermore, absorbent biodegradable liner 110 may include narrow slit 165 extending from through-hole 160 to an edge of body 112 of dimensional shape 130. Narrow slit 165 may be deformable useful for allowing faucet neck 106 of sink 105 to pass through absorbent biodegradable liner 110 to reach through-hole 160.

According to a preferred embodiment, both absorbent biodegradable liner 110 and liner package 125 may be biodegradable. In such a manner, liner package 125 may be disposed of in an environmentally friendly manner by either flushing down a toilet or thrown into the trash.

In continuing to refer to FIG. 3, absorbent biodegradable liner 110 is shown comprising dimensional shape 130. In one embodiment, dimensional shape 130 may comprise round shape 305. As shown, round shape 305 may be elongated and configured to fit around sink 105 having any convenient rounded shape, including but not limited to an oblong, elliptical, or oval configuration. Similarly, round shape 305 may be tailored or otherwise fitted. For example, round shape 305 may be substantially circular and configured to fit around sink 105 having a circle configuration. In another embodiment, dimensional shape 130 may comprise a substantially rectangle shape 310, and likewise may be tailored or otherwise configured to fit around sink 105 having a particular rectangular or square configuration. Other shapes are contemplated by this disclosure.

Figure 4:
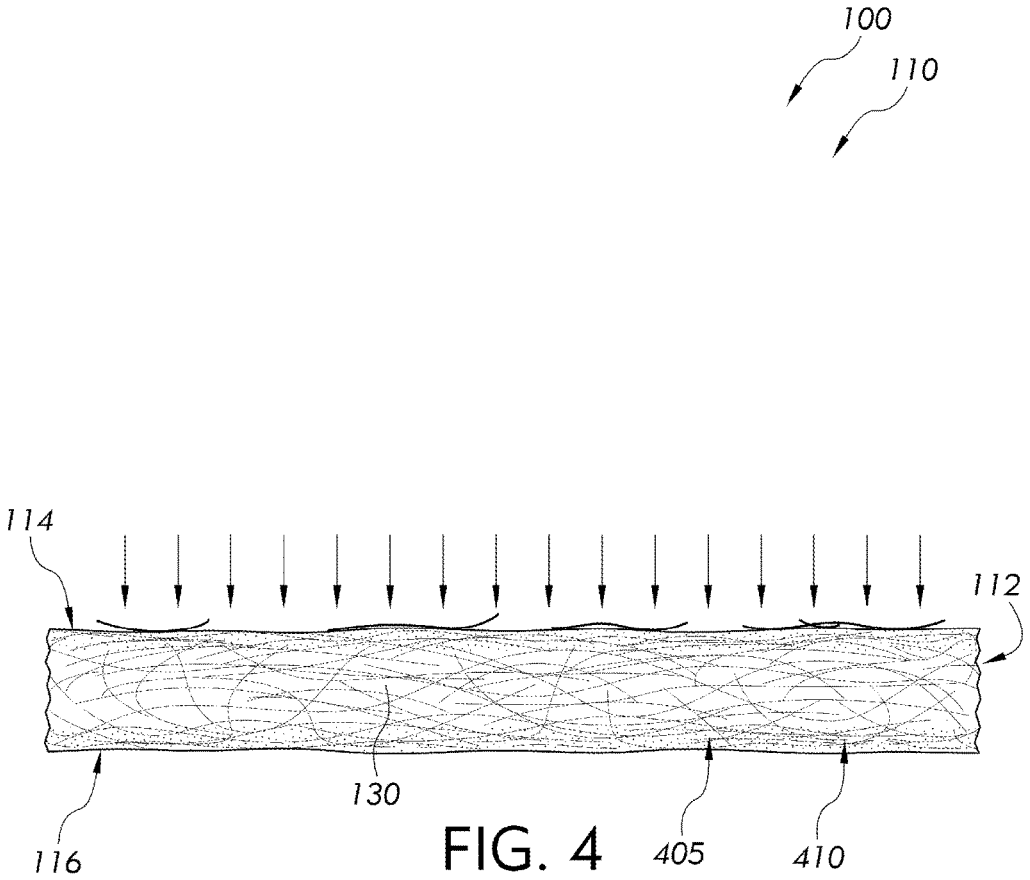
FIG. 4 is a cross sectional view of the liner according to one embodiment of FIG. 3, illustrating a liquid composition saturating the body of the absorbent biodegradable liner.

Referring now to FIG. 4, liquid composition 120 may preferably include at least one antibacterial agent. Liquid composition 120 may aid body 112 by absorbedly-collecting shaved hairs 145 that naturally fall while user 140 is cutting facial hair and alternatively head hair over sink 105. Liquid composition 120 may be configured to aid body 112 in retaining human hair that falls onto body 112 during 'in-use' condition 150. In some manners of use, shaved hairs 145 may comprise whiskers. In other manners of use, shaved hairs 145 may comprise head hair.

As may be noted, absorbent biodegradable liner 110 may comprise a piece of paper or cloth structured and arranged to absorb liquid composition 120. In one embodiment of the present invention, at least one antibacterial agent may include antiseptic solution 405. In another embodiment of the present invention, at least one antibacterial agent may include alcohol solution 410. In such a manner, antiseptic solution 405 and alternatively alcohol solution 410 may be useful for cleaning a surface of sink 105 while killing harmful bacteria.

In one embodiment of the present invention, disposable facial hair grooming sink liner and wipe 100 may comprise: absorbent biodegradable liner 110 having body 112, first surface 114, and second surface 116 with first surface 114 and second surface 116 being located on opposing sides of body 112, first surface 114 and second surface 116 having a substantially similar deployed footprint; liquid composition 120 saturating body 112; and liner package 125. Absorbent biodegradable liner 110, liquid composition 120, and liner package 125 are in functional combination. Absorbent biodegradable liner 110 is structurally defined by first surface 114 and second surface 116 of body 112, and is shaped so. Further, liner package 125 is structured and arranged to sanitarily retain absorbent biodegradable liner 110 when in its folded-condition. During 'in-use' condition 150, absorbent biodegradable liner 110 is deployable by user 140 about and around sink 105 when removed from liner package 125 and in unfolded-condition 210. As may be appreciated, disposable facial hair grooming sink liner and wipe 100 is advantageously configured to collect shaved hairs 145 when user 140 shaving over sink 105 thereby minimizing messiness of a bathroom or washroom and clean up time of sink 105.

It should be noted that disposable facial hair grooming sink liner and wipe 100 may be sold as a kit comprising the following parts: absorbent biodegradable liner; liquid composition saturating body; liner package; and at least one set of user instructions. The kit has instructions such that functional relationships are detailed in relation to the structure of the invention (such that the invention can be used, maintained, or the like in a preferred manner).

Disposable facial hair grooming sink liner and wipe 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
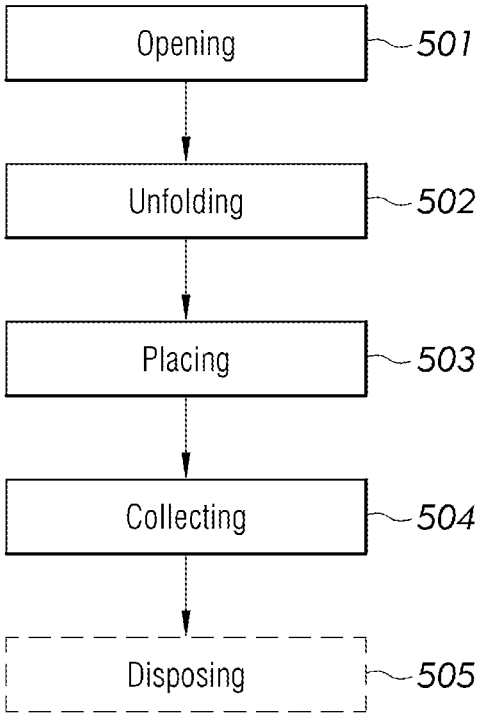
FIG. 5 is a flowchart illustrating a method of use for the disposable facial hair grooming sink liner and wipe of FIGS. 1-4, according to an embodiment of the present disclosure.

Referring now to FIG. 5 showing flowchart illustrating method of use 500 for disposable facial hair grooming sink liner and wipe 100 according to an embodiment of the present disclosure of FIGS. 1-4. As shown, method of use 500 may comprise the steps of: step one 501, opening liner package and removing absorbent biodegradable liner in folded-condition; step two 502, unfolding absorbent biodegradable liner; step three 503, placing absorbent biodegradable liner about and around sink; step four 504, collecting shaved hairs of user when user is shaving; and step five 505, disposing absorbent biodegradable liner, such as in an environmentally-friendly manner.

It should be noted that step five 505 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. § 112(f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A disposable facial hair grooming sink liner and wipe comprising:

a) an absorbent biodegradable liner having a body, a first surface, and a second surface;

b) a liquid composition saturating said body; and c) a liner package;

d) wherein said absorbent biodegradable liner, said liquid composition, and said liner package are in functional combination;

e) wherein said liquid composition is structured and arranged to aid said body by absorbedly-collecting shaved hairs that naturally fall while a user is cutting facial hair and alternatively head hair over said sink;

f) wherein said liquid composition is structured and arranged to aid said body in retaining human hair that falls onto said body;

g) wherein said absorbent biodegradable liner is structurally defined by said first surface and said second surface of said body, and forms a dimensional shape;

h) wherein said liner package is structured and arranged to sanitarily retain said absorbent biodegradable liner when in a folded-condition;

i) wherein said absorbent biodegradable liner is deployable about and around a sink when in an unfolded-condition; and j) wherein said disposable facial hair grooming sink liner and wipe is configured to collect the shaved hairs during shaving.

2. The disposable facial hair grooming sink liner and wipe of claim 1, wherein said body of said absorbent biodegradable liner includes a through-hole structured to accommodate a faucet neck of said sink.

3. The disposable facial hair grooming sink liner and wipe of claim 2, wherein said through-hole is located at an upper middle region of said dimensional shape.

4. The disposable facial hair grooming sink liner and wipe of claim 3, wherein said absorbent biodegradable liner includes a narrow slit extending from said through-hole to an edge of said body of said dimensional shape.

5. The disposable facial hair grooming sink liner and wipe of claim 4, wherein said narrow slit is deformable for allowing said faucet neck of said sink to pass through said absorbent biodegradable liner and reach said through-hole.

6. The disposable facial hair grooming sink liner and wipe of claim 5, wherein said liner package is biodegradable.

7. The disposable facial hair grooming sink liner and wipe of claim 6, wherein said liquid composition includes at least one antibacterial agent.

8. The disposable facial hair grooming sink liner and wipe of claim 7, wherein said at least one antibacterial agent includes an antiseptic solution.

9. The disposable facial hair grooming sink liner and wipe of claim 7, wherein said at least one antibacterial agent includes an alcohol solution.

10. The disposable facial hair grooming sink liner and wipe of claim 7, wherein said dimensional shape includes a rounded shape.

11. The disposable facial hair grooming sink liner and wipe of claim 10, wherein said rounded shape is elongated and configured to fit around said sink, where said sink has an oval configuration.

12. The disposable facial hair grooming sink liner and wipe of claim 10, wherein said rounded shape is substantially circular and configured to fit around said sink, where said sink has a circle configuration.

13. The disposable facial hair grooming sink liner and wipe of claim 7, wherein said dimensional shape is a substantially rectangular shape, and is configured to fit around said sink, where said sink has a substantially rectangular or a substantially square configuration.

14. A disposable facial hair grooming sink liner and wipe comprising:

a) an absorbent biodegradable liner having a body, a first surface, and a second surface, said first surface and said second surface being located on opposing sides of said body, said first surface and said second surface having a substantially similar deployed footprint;
b) a liquid composition saturating said body; and
c) a liner package;
d) wherein said absorbent biodegradable liner, said liquid composition, and said liner package are in functional combination;
e) wherein said liquid composition is structured and arranged to aid said body by absorbedly-collecting shaved hairs that naturally fall while a user is cutting facial hair and alternatively head hair over said sink;
f) wherein said liquid composition is structured and arranged to aid said body in retaining human hair that falls onto said body;
g) wherein said liner package is structured and arranged to sanitarily retain said absorbent biodegradable liner when in a folded-condition;
h) wherein said absorbent biodegradable liner is deployable about and around a sink when in an unfolded-condition; and
i) wherein said disposable facial hair grooming sink liner and wipe is configured to collect shaved hairs during shaving.

15. The disposable facial hair grooming sink liner and wipe of claim 14, further comprising a set of user instructions, said disposable facial hair grooming sink liner and wipe configured as a kit.

16. A method of using a disposable facial hair grooming sink liner and wipe, the method comprising the steps of:

a) providing a disposable facial hair grooming sink liner and wipe comprising:
   i) an absorbent biodegradable liner having a body, a first surface, and a second surface;
   ii) a liquid composition saturating said body;
   iii) a liner package; and
   iv) instructions;
   v) wherein said absorbent biodegradable liner, said liquid composition, and said liner package are in functional combination;
   vi) wherein said liquid composition is structured and arranged to aid said body by absorbedly-collecting shaved hairs that naturally fall while said a user is cutting facial hair and alternatively head hair over said sink;
   vii) wherein said liquid composition is structured and arranged to aid said body in retaining human hair that falls onto said body;
   viii) wherein said absorbent biodegradable liner is structurally defined by said first surface and said second surface of said body, and forms a dimensional shape;
   ix) wherein said liner package is structured and arranged to sanitarily retain said absorbent biodegradable liner when in a folded-condition;
   x) wherein said absorbent biodegradable liner is deployable about and around a sink when in an unfolded-condition; and
   xi) wherein said disposable facial hair grooming sink liner and wipe is configured to collect the shaved hairs during shaving;
b) opening said disposable facial hair grooming sink liner and wipe;
c) removing said absorbent biodegradable liner;
d) unfolding said absorbent biodegradable liner;
e) placing said absorbent biodegradable liner about and around a sink; and
f) collecting a plurality of the shaved hairs of the user during shaving.

17. The method of claim 16, further comprising the steps of disposing said absorbent biodegradable liner.

* * * * *